US009011005B2

(12) United States Patent
Lin et al.

(10) Patent No.: US 9,011,005 B2
(45) Date of Patent: Apr. 21, 2015

(54) GEOTEXTILE CONTAINER

(71) Applicant: Gold-Joint Industry Co., Ltd., Taichung (TW)

(72) Inventors: Ching-Yi Lin, Taichung (TW); Hsuan-Hui Tang, Taichung (TW); Chun-Jung Tseng, Taichung (TW)

(73) Assignee: Gold-Joint Industry Co., Ltd., Taichung (TW)

( * ) Notice: Subject to any disclaimer, the term of this patent is extended or adjusted under 35 U.S.C. 154(b) by 0 days.

(21) Appl. No.: 13/683,411

(22) Filed: Nov. 21, 2012

(65) Prior Publication Data

US 2013/0322789 A1 Dec. 5, 2013

(30) Foreign Application Priority Data

May 29, 2012 (TW) ..... 101210218 U

(51) Int. Cl.

| | |
|---|---|
| ***B65D 30/04*** | (2006.01) |
| ***B65D 30/08*** | (2006.01) |
| ***B65D 30/00*** | (2006.01) |
| ***B65D 33/01*** | (2006.01) |
| ***E02B 3/04*** | (2006.01) |
| ***E02B 3/06*** | (2006.01) |
| ***B63B 35/30*** | (2006.01) |
| ***B65D 33/00*** | (2006.01) |
| ***E02B 3/12*** | (2006.01) |
| *B63B 35/28* | (2006.01) |

(52) U.S. Cl.

CPC ..... *B65D 33/00* (2013.01); *E02B 3/127* (2013.01); *B63B 35/285* (2013.01)

(58) Field of Classification Search

USPC ..... 383/117, 109, 113, 108, 100–103; 405/15, 32; 114/27

See application file for complete search history.

(56) References Cited

U.S. PATENT DOCUMENTS

| | | | | |
|---|---|---|---|---|
| 3,248,041 | A * | 4/1966 | Burke | 383/101 |
| 3,670,504 | A * | 6/1972 | Hayes et al. | 405/32 |
| 3,674,073 | A * | 7/1972 | Hendon | 383/18 |
| 4,878,446 | A * | 11/1989 | Vermeulen | 114/27 |
| 4,919,820 | A * | 4/1990 | Lafay et al. | 210/671 |
| 6,056,438 | A * | 5/2000 | Bradley | 383/66 |
| 6,652,145 | B2 * | 11/2003 | Valdez | 383/102 |
| 6,857,819 | B2 * | 2/2005 | Gunderson, III | 405/60 |
| 7,449,105 | B2 * | 11/2008 | Hastings | 210/85 |
| 7,661,223 | B2 * | 2/2010 | Dudney | 43/26 |
| 2006/0127182 | A1 * | 6/2006 | Sanguinetti | 405/20 |
| 2009/0129866 | A1 * | 5/2009 | Smallwood et al. | 405/16 |

FOREIGN PATENT DOCUMENTS

| | | | |
|---|---|---|---|
| EP | 0275573 | A1 | 7/1988 |
| WO | WO-9729247 | A1 | 8/1997 |

* cited by examiner

*Primary Examiner* — Jes F Pascua
*Assistant Examiner* — Derek Battisti
(74) *Attorney, Agent, or Firm* — Rabin & Berdo, P.C.

(57) ABSTRACT

A geotextile container has a bag section, a cover section and a stuffing space. The bag section has a bag cloth, a bag non-woven fabric and a trapezoidal longitudinal section. The cover section is integrally connected with the bag section and has a cover cloth and a cover non-woven fabric. The stuffing space is formed inside the bag section and has a first margin portion. A longitudinal section of the stuffing space is trapezoidal. The first margin portion is formed at a side of a bottom of the stuffing space. The first margin portion can be immediately unfolded and contain filling materials once the geotextile container is projected into the sea.

12 Claims, 7 Drawing Sheets

GEOTEXTILE CONTAINER

BACKGROUND OF THE INVENTION

1. Field of the Invention

The present invention relates to a geotextile container, and more particularly to a geotextile container having a sufficient and immediate margin for receiving filling materials.

2. Description of Related Art

A conventional geotextile container is made of high strength and good permeability geotextiles to form a large fabric cell or bag. The geotextile container is commonly filled with sand, sediment or other fillings. When full, the geotextile container is then stitched up and sinks to an appropriate or projected site. The geotextile container is mainly applied for coastal and river improvements.

With reference to U.S. Pat. No. 4,878,446, a conventional geotextile container has multiple expansion gussets. Each expansion gusset has two cloth parts sewn with each other. On exertion of tensile forces, sewn seams on the two cloth parts will be loaded first. If the forces are so great that this seam fails, the expansion gusset is unfolded, such that there comes about an extra margin or length in the cloth of container in the direction of tensile force. Should this not be sufficient, another sewn seam can also still fail.

However, when the geotextile container encounters a shock, such as when the geotextile container is hit by a sudden ocean current, or is suddenly bumped by the desired ground, the geotextile container easily fractures or swells due to a sudden influx of seawater. This is because the sewn seams are often sewn tightly and do not easily fracture such that the gusset fails to be unfolded. Or, the sewn seams fracture too slowly such that the geotextile container cannot have sufficient margin for receiving filling materials in time.

To overcome the shortcomings, the present invention tends to provide a geotextile container to mitigate the aforementioned problems.

SUMMARY OF THE INVENTION

The main objective of the invention is to provide a geotextile container having a sufficient and immediate margin for receiving filling materials.

A geotextile container has a bag section, a cover section and a stuffing space. The bag section has a bag cloth, a bag non-woven fabric and a trapezoidal longitudinal section. The cover section is integrally connected with the bag section and has a cover cloth and a cover non-woven fabric. The stuffing space is formed inside the bag section and has a first margin portion. A longitudinal section of the stuffing space is trapezoidal. The first margin portion is formed at a side of a bottom of the stuffing space. The first margin portion can be immediately unfolded and contain filling materials once the geotextile container is projected into the sea.

Other objects, advantages and novel features of the invention will become more apparent from the following detailed description when taken in conjunction with the accompanying drawings.

DETAILED DESCRIPTION OF PREFERRED EMBODIMENT

Figure 1:
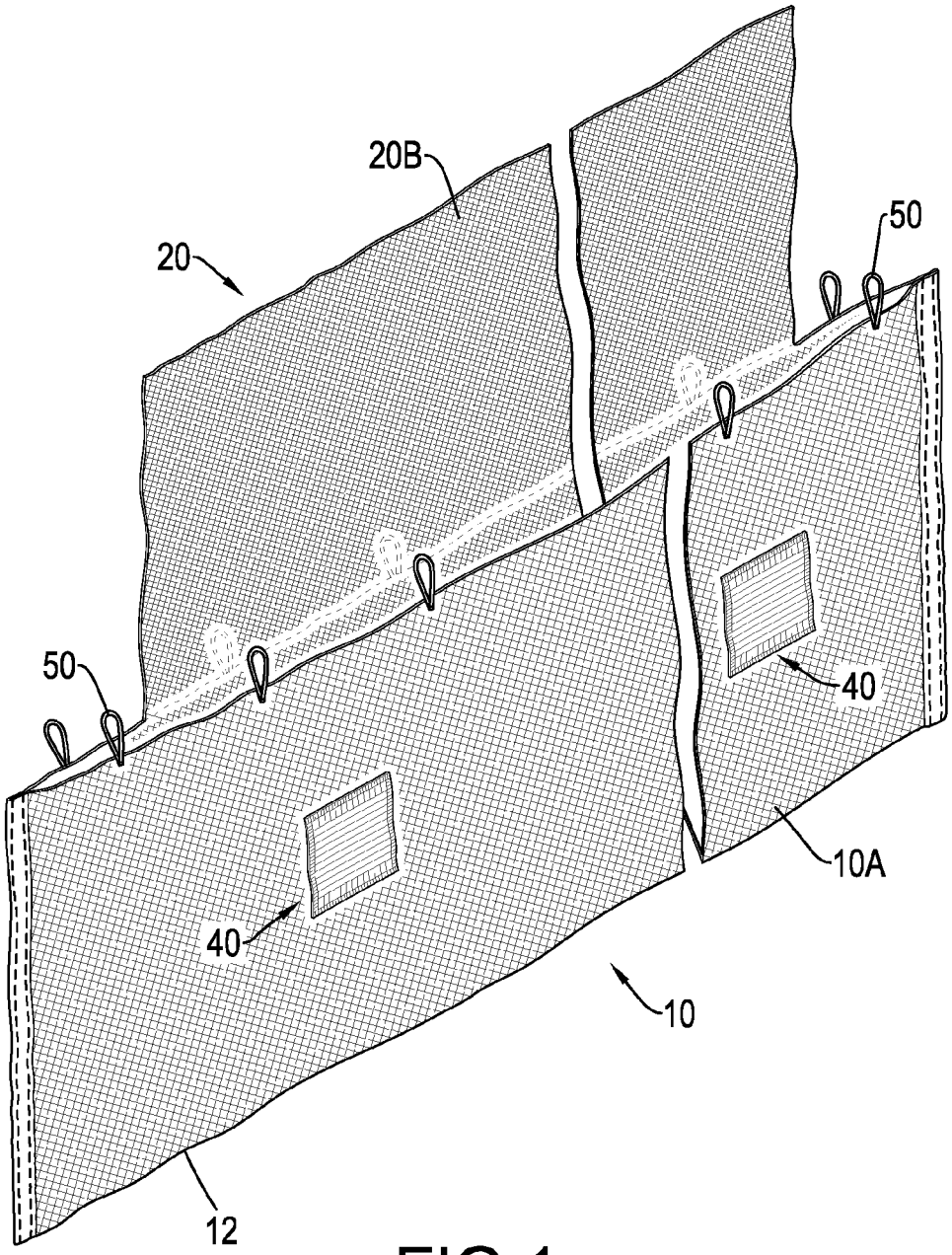
FIG. 1 is a perspective view of a geotextile container in accordance with the present invention.
Figure 2:
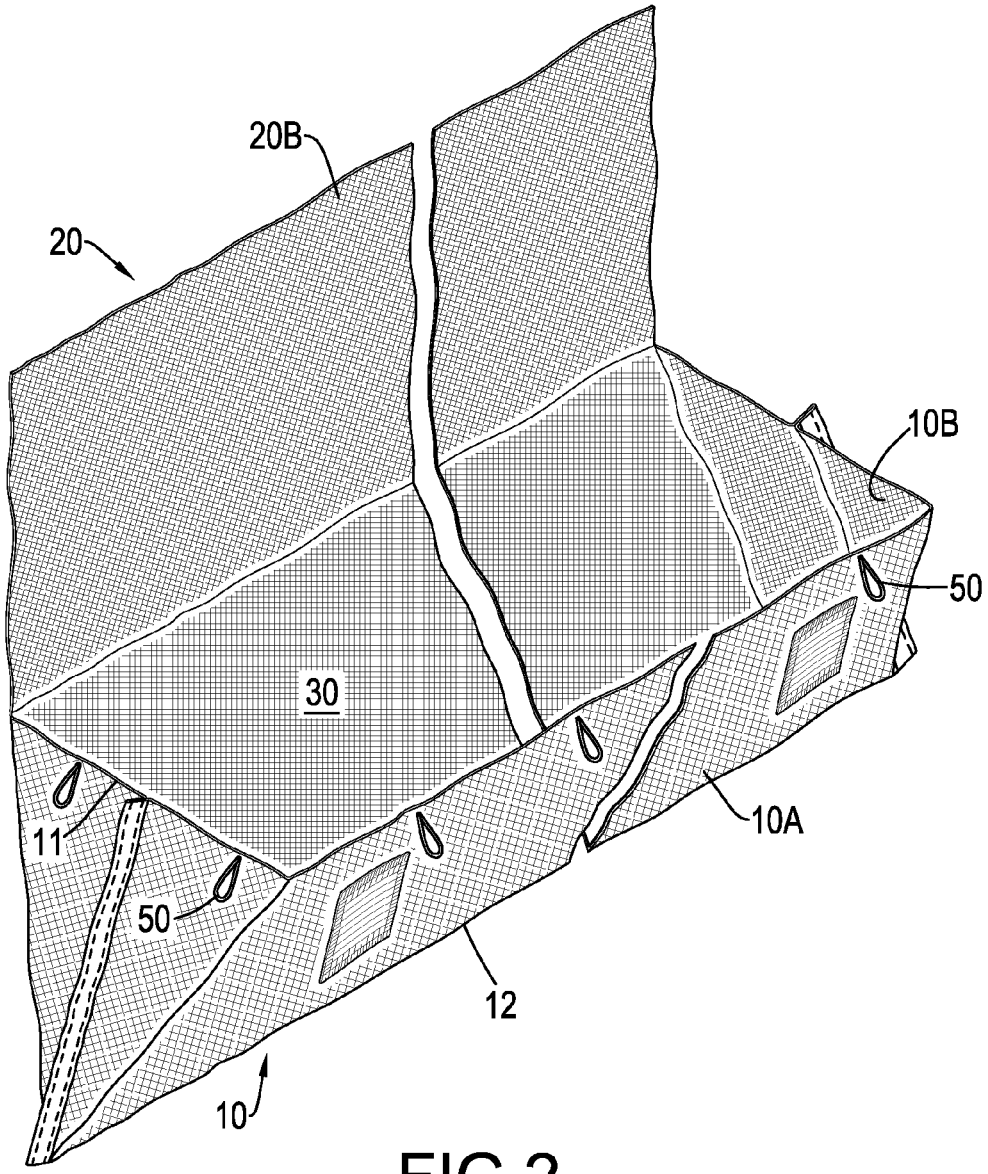
FIG. 2 is a perspective view of the geotextile container in FIG. 1 showing the geotextile container being loosened.

With reference to FIGS. 1 to 6, a geotextile container in accordance with the present invention is capable of being filled with materials and sinking into the sea. The geotextile container comprises a bag section 10, a cover section 20 and a stuffing space 30. The bag section 10 is elongated and hollow and has a bag cloth 10A, a bag non-woven fabric 10B, a top edge 11, a bottom edge 12 and a longitudinal section. The bag cloth 10A is formed as an outer surface of the bag section 10. The bag non-woven fabric 10B is integrally connected with the bag cloth 10A and is formed as an inner surface of the bag section 10.

The bottom edge 12 of the bag section 10 is opposite to the top edge 11 of the bag section 10. The longitudinal section of the bag section 10 is trapezoidal.

Preferably, the bag section 10 has a triangular cross section. Accordingly, the top edge 11 of the bag section 10 is rectangular. The bottom edge 12 of the bag section 10 is linear and extends lengthwise.

The cover section 20 is integrally connected with a side of the top edge 11 of the bag section 10, is capable of covering the top edge 11 of the bag section 10 to enclose the bag section 10, and has a cover cloth 20A and a cover non-woven fabric 20B.

The cover cloth 20A is formed as an outer surface of the cover section 20, and is integrally connected with the bag cloth 10A. The cover non-woven fabric 20B is integrally connected with the cover cloth 20A, is formed as an inner surface of the cover section 20, and is integrally connected with the bag non-woven fabric 10B.

The stuffing space 30 is formed inside the bag section 10, is capable of being filled with filling materials, and has a longitudinal section, a bottom, a triangular first margin portion 31 and a triangular second margin portion 32. The longitudinal section of the stuffing space 30 is trapezoidal. The bottom of the stuffing space 30 is adjacent to the bottom edge 12 of the bag section 10. The first margin portion 31 and the second margin portion 32 are respectively formed at two opposite sides of the bottom of the stuffing space 30.

Preferably, the geotextile container has multiple vents 40 and multiple loops 50. The vents 40 are respectively mounted on the bag section 10 and the cover section 20. Each vent 40 has a central area 41 and a border area 42 encompassing the central area 41 of the vent 40.

Figure 3:
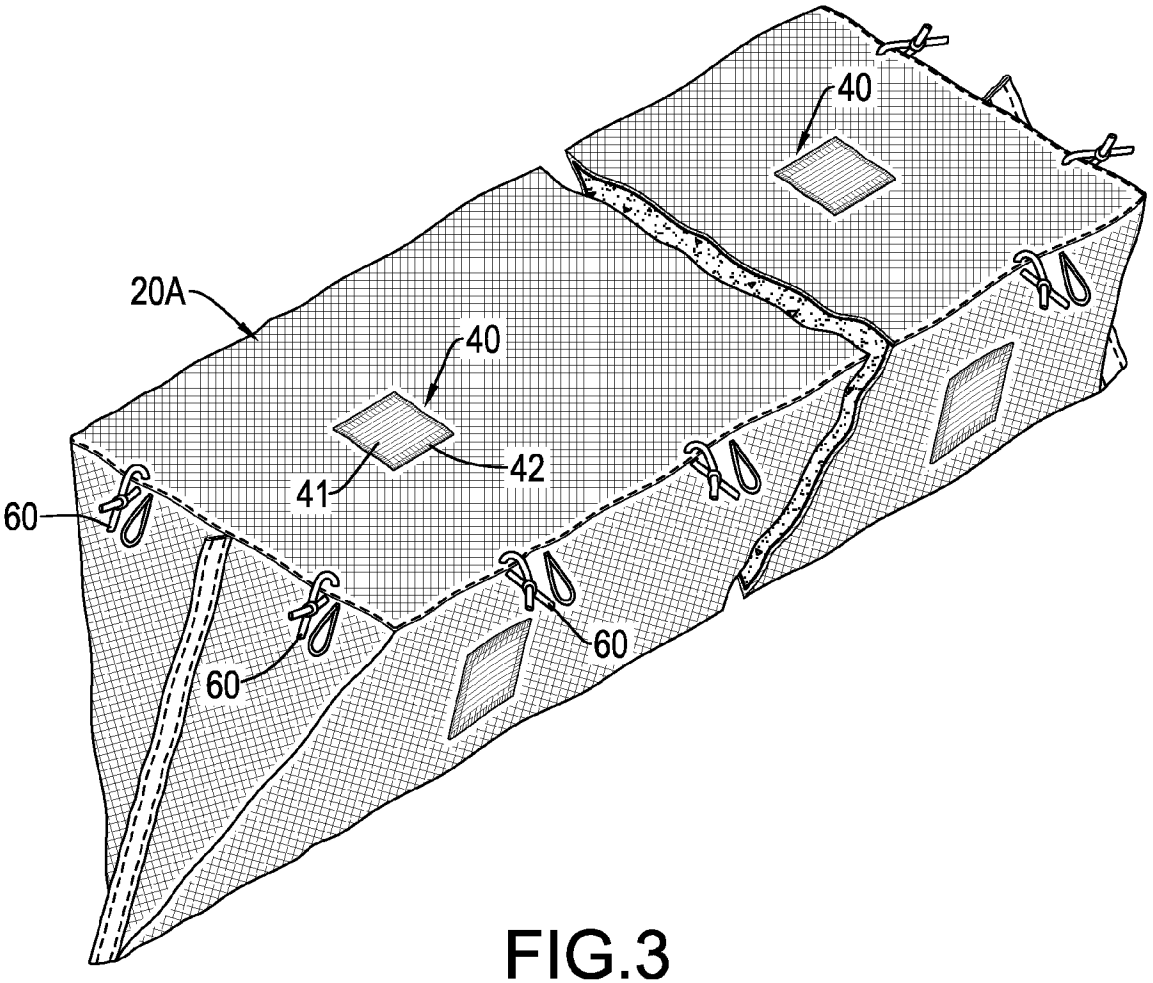
FIG. 3 is a perspective view of the geotextile container in FIG. 1 showing knots securely connecting the cover section with the top edge of the bag section.

With reference to FIG. 3, preferably, the geotextile container has multiple knots 60 securely connecting the cover section 20 with the top edge 11 of the bag section 10.

A weaving density of the central area 41 of each vent 40 is lower than that of the border area 42 of the vent 40, is lower than that of the bag cloth 10A of the bag section 10, and is lower than that of the cover cloth 20A of the cover section 20. The weaving density of the border area 42 of each vent 40 is higher than that of the bag cloth 10A of the bag section 10, and is higher than that of the cover cloth 20A of the cover section 20. Accordingly, seawater easily flows into the stuffing space 30 via the vents 40 than via the cover section 20 and the bag section 10. The vents 40 also accelerate the escape of air in the geotextile container after projected so as to lower the geotextile container's buoyancy and to diminish deviation caused by the buoyancy.

Preferably, the multiple loops 50 are securely mounted on the outer surface of the bag section 10 at intervals, and are adjacent to the top edge 11 of the bag section 10.

Figure 4:
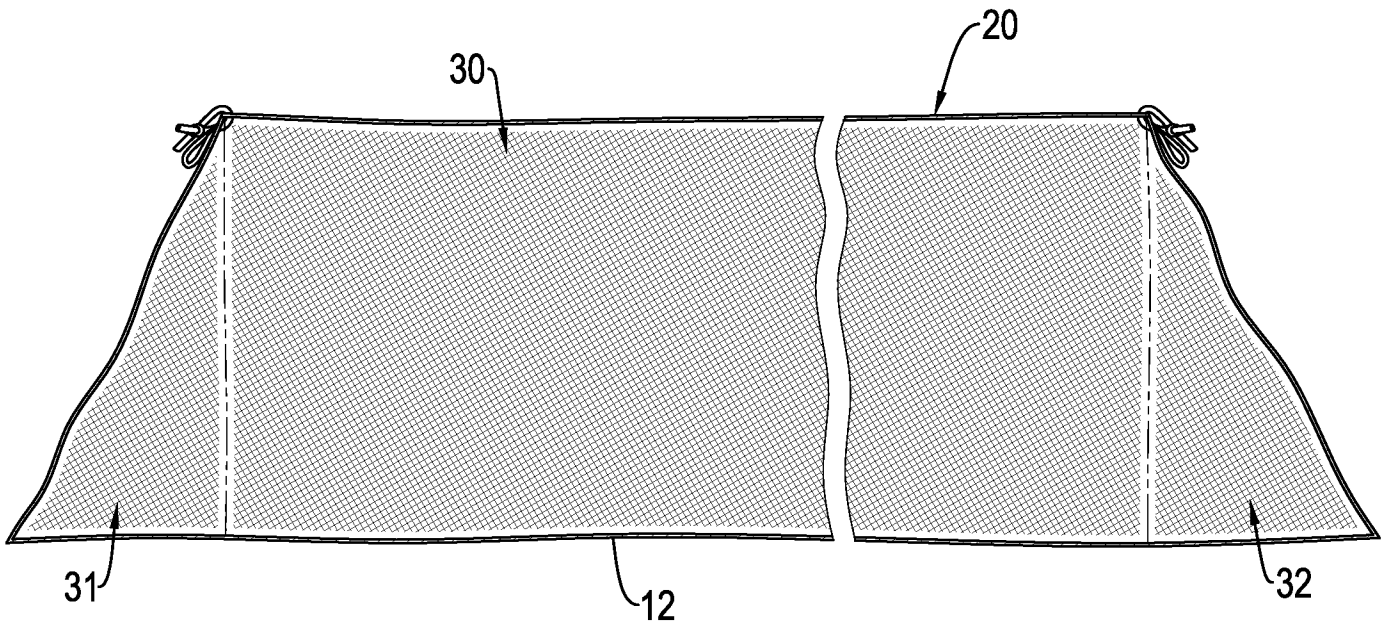
FIG. 4 is a longitudinal sectional side view of the geotextile container in FIG. 2.
Figure 6:
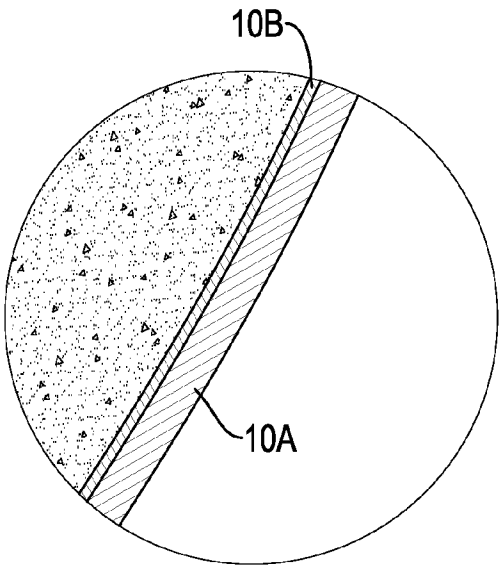
FIG. 6 is an enlarged cross sectional end view of the geotextile container in FIG. 5.
Figure 5:
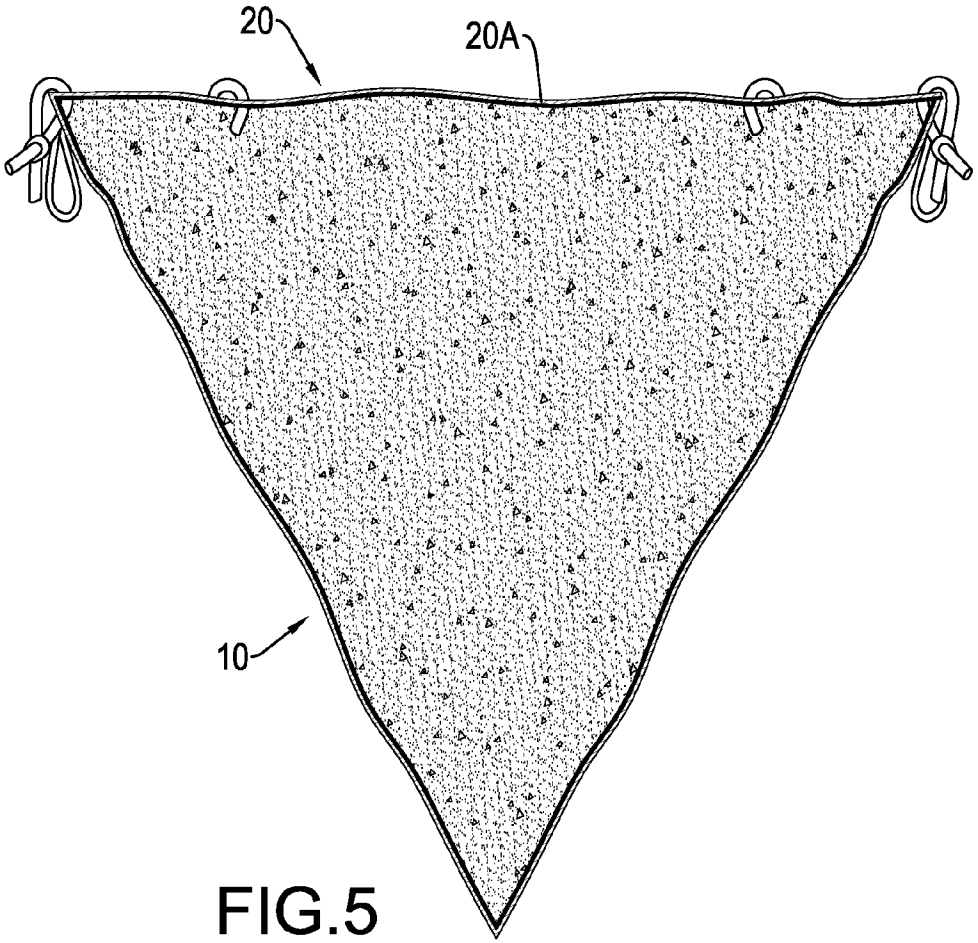
FIG. 5 is an enlarged cross sectional end view of the geotextile container in FIG. 2.
Figure 7:
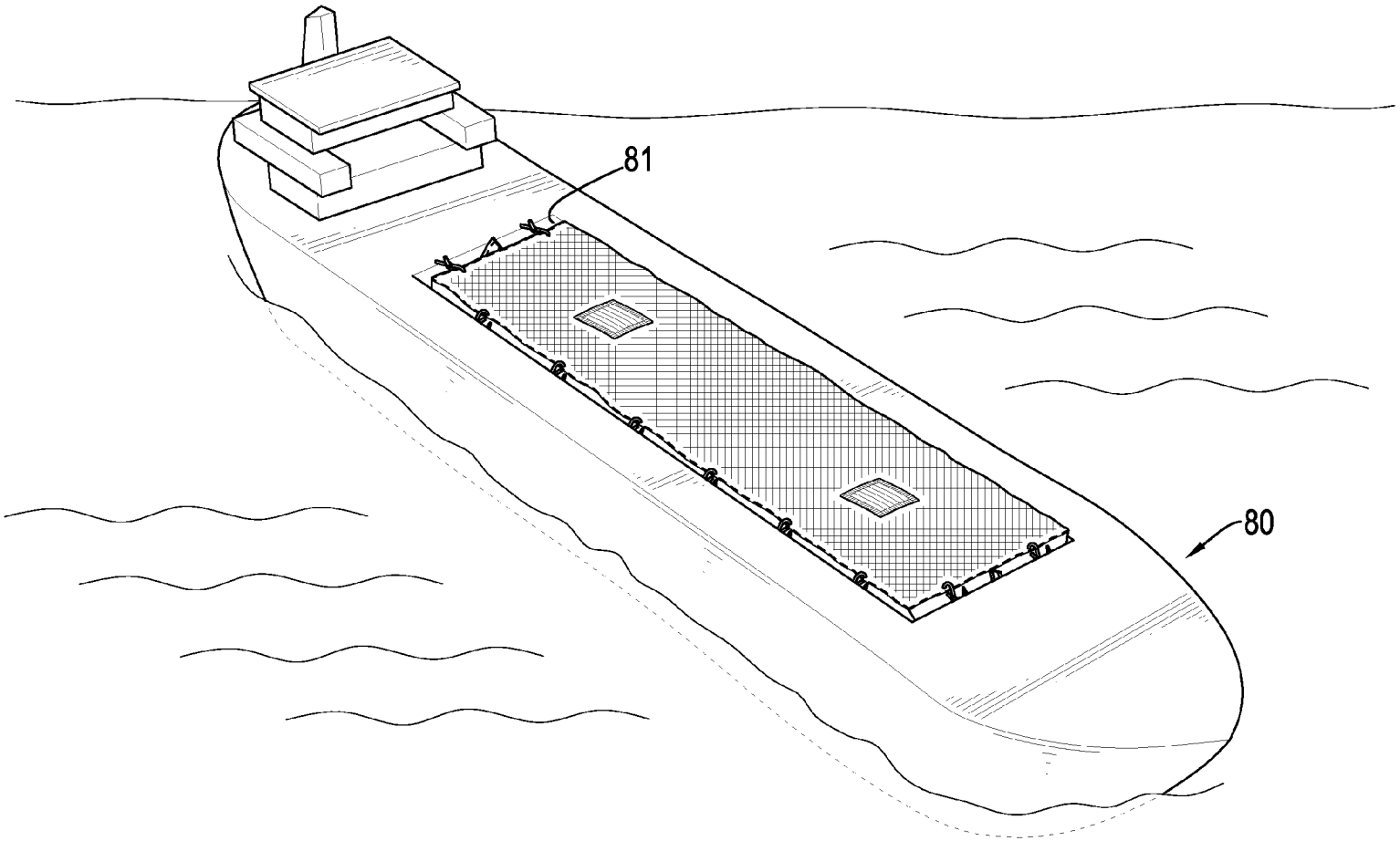
FIG. 7 is an operational perspective view of the geotextile container showing the geotextile container being placed into a tank of a vessel.
Figure 8:
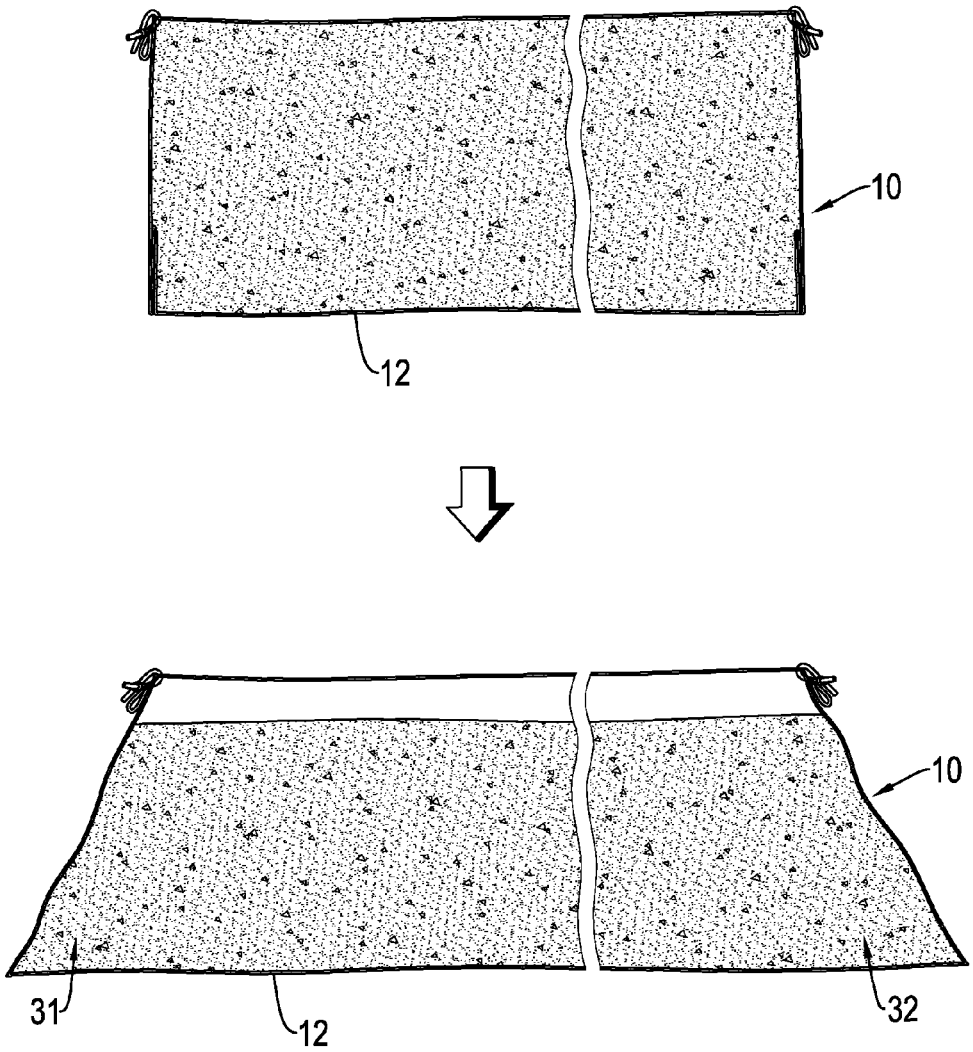
FIG. 8 is operational longitudinal sectional side views of the geotextile container showing the filling materials entering the first margin portion and the second margin portion.

With reference to FIGS. 4 and 8, because of the trapezoidal longitudinal section of the stuffing space 30, the stuffing space 30 has the first margin portion 31 and the second margin portion 32. With further reference to FIG. 7, when the geotextile container in accordance with the present invention is placed into a tank 81 of a vessel 80, two corners of the bag section 10 are folded because a length of the geotextile container is larger than that of the tank 81. Accordingly, the first margin portion 31 and the second margin portion 32 are greatly compressed by the tank 81.

When the geotextile container is filled with materials, the filling materials do not enter the compressed first margin portion 31 and the compressed second margin portion 32. Finally, an edge of the cover section 20 is sewed on the top edge 11 of the bag section 10 to enclose the bag section 10, and then the knots 60 further securely connect the bag section 10 and the cover section 20.

Once the geotextile container is projected into the sea and the seawater permeates the stuffing space 30, the bag section 10 immediately loosens, such that the first margin portion 31 and the second margin portion 32 immediately contain part of the filling materials in the stuffing space 30. Consequently, the filling materials in the stuffing space 30 can freely move in the stuffing space 30 before the geotextile container sinks to a desired ground.

Accordingly, the geotextile container is prevented from fracturing when hit by a sudden ocean current or suddenly bumped by the desired ground, and from swelling due to a sudden influx of seawater.

In addition, the second margin portion 32 is optional. With the first margin portion 31, the geotextile container in accordance with the present invention can have a sufficient and immediate margin for receiving filling materials.

From the above description, it is noted that the present invention has the following advantages:

1. Sufficient and immediate margin:

Because the stuffing space 30 has the trapezoidal longitudinal section, the stuffing space 30 has the first margin portion 31 and the second margin portion 32. The first margin portion 31 and the second margin portion 32 can immediately contain the filling materials once the geotextile container is projected into the sea, and this can avoid the fracture of the geotextile container when the geotextile container encounters shocks.

2. Sufficient containing volume with the immediate margin:

The conventional geotextile container may be not fully filled with the filling materials to have an immediate margin. For example, 80% of the stuffing space of the conventional geotexile container is filled to have a 20% immediate margin. Therefore, the usable volume of the stuffing space of the conventional geotextile container is reduced.

Nevertheless, the geotextile container in accordance with the present invention can contain more filling materials than the conventional geotextile container does. For example, assuming that the volume of the tank 81 of the vessel 80 is fixed and is 100 $m^3$ (cubic meters), the geotextile container of the present invention placed in the tank 81 can contain filling materials of approximate 100 $m^3$. However, the conventional geotextile container placed in the tank 81 may contain filling materials of 80 $m^3$ to create an immediate margin. Accordingly, less geotextile containers of the present invention are required to produce the same desired effect.

3. Strengthened structure of each vent 40:

Because the weaving density of the border area 42 of the vent 40 is higher than that of the central area 41 of the vent 40, the border area 42 enhances the structural strength of each vent 40.

4. Easy and fast positioning:

Because the loops 50 are quickly and easily hung on pins of the vessel 80, the geotextile container is easily positioned on the tank 81 for sequent filling of materials.

5. Enhanced connection between the bag section 10 and the cover section 20:

Because the knots 60 further securely connect the bag section 10 and the cover section 20, the connection between the bag section 10 and the cover section 20 is strengthened.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A geotextile container, capable of being filled with filling materials and sinking into a sea, the geotextile container comprising:

an elongated and hollow bag section having a bag cloth formed as an outer surface of the bag section;

a bag non-woven fabric integrally connected with the bag cloth and formed as an inner surface of the bag section;

a top edge having a length;

a bottom edge opposite to the top edge of the bag section and having a length that is longer than the length of the top edge;

a trapezoidal longitudinal section;

a cover section, integrally connected with a side of the top edge of the bag section, capable of covering the top edge of the bag section to enclose the bag section, and having a cover cloth formed as an outer surface of the cover section, and integrally connected with the bag cloth; and a cover non-woven fabric integrally connected with the cover cloth, formed as an inner surface of the cover section, and integrally connected with the bag non-woven fabric; and a stuffing space formed inside the bag section, capable of being filled with the filling materials, and having a trapezoidal longitudinal section;

a bottom adjacent to the bottom edge of the bag section; and a first margin portion formed at a side of the bottom of the stuffing space, wherein the first margin portion is compressed and is kept from being filled with filling material before the bag section is expanded.

2. The geotextile container as claimed in claim 1, wherein the stuffing space further has a second margin portion; and the first margin portion and the second margin portion are respectively formed at two opposite sides of the bottom of the stuffing space.

3. The geotextile container as claimed in claim 1, further comprising multiple vents respectively mounted on the bag section and the cover section, the vents allowing sea water to flow therethrough.

4. The geotextile container as claimed in claim 2, further comprising multiple vents respectively mounted on the bag section and the cover section, the vents allowing sea water to flow therethrough.

5. The geotextile container as claimed in claim 3, wherein each of the vents has a central area having a weaving density; and a border area encompassing the central area of the vent, and having a weaving density, wherein the weaving density of the central area of the vent is lower than that of the border area of the vent so that the sea water flows through the central area, and the weaving density of the border area of the vent is higher than that of the bag cloth of the bag section, and is higher than that of the cover cloth of the cover section.

6. The geotextile container as claimed in claim 4, wherein each of the vents has a central area having a weaving density; and a border area encompassing the central area of the vent, and having a weaving density, wherein the weaving density of the central area of the vent is lower than that of the border area of the vent so that the sea water flows through the central area, and the weaving density of the border area of the vent is higher than that of the bag cloth of the bag section, and is higher than that of the cover cloth of the cover section.

7. The geotextile container as claimed in claim 1, further comprising multiple loops respectively mounted on the outer surface of the bag section at intervals, and being adjacent to the top edge of the bag section.

8. The geotextile container as claimed in claim 6, further comprising multiple loops respectively mounted on the outer surface of the bag section at intervals, and being adjacent to the top edge of the bag section.

9. The geotextile container as claimed in claim 1, further comprising multiple knots securely connecting the cover section with the top edge of the bag section.

10. The geotextile container as claimed in claim 8, further comprising multiple knots securely connecting the cover section with the top edge of the bag section.

11. The geotextile container as claimed in claim 1, wherein the bag section has a triangular cross section;

the top edge of the bag section is rectangular;

the bottom edge of the bag section is linear and extends lengthwise; and the cover section is rectangular.

12. The geotextile container as claimed in claim 10, wherein the bag section has a triangular cross section;

the top edge of the bag section is rectangular;

the bottom edge of the bag section is linear and extends lengthwise; and the cover section is rectangular.

* * * * *